US012643012B2

(12) United States Patent
Lothian et al.

(10) Patent No.: US 12,643,012 B2
(45) Date of Patent: Jun. 2, 2026

(54) INSTRUMENTED LOAD CELL DEVICE, FITNESS SYSTEM AND METHOD USING SAME

(71) Applicant: Upstream Tec Inc., Ottawa (CA)

(72) Inventors: Gregory James Lothian, Ottawa (CA); Sean Cloghesy, Ottawa (CA)

(73) Assignee: Upstream Tec Inc., Ottawa (CA)

( * ) Notice: Subject to any disclaimer, the term of this patent is extended or adjusted under 35 U.S.C. 154(b) by 21 days.

(21) Appl. No.: 18/678,786

(22) Filed: May 30, 2024

(65) Prior Publication Data

US 2025/0367505 A1 Dec. 4, 2025

(51) Int. Cl.
*A63B 24/00* (2006.01)
*A63B 21/04* (2006.01)

(52) U.S. Cl.
CPC ..... *A63B 24/0062* (2013.01); *A63B 21/0442* (2013.01)

(58) Field of Classification Search
CPC ..... A63B 21/0442; A63B 24/0062
See application file for complete search history.

(56) References Cited

U.S. PATENT DOCUMENTS 5,538,486 A * 7/1996 France ..... A63B 21/4035 482/121
11,524,204 B2 * 12/2022 Jauregui ..... G16H 20/30
2008/0132388 A1 * 6/2008 Clem ..... A63B 21/0004 482/91
2012/0302406 A1 * 11/2012 Hinds ..... A63B 21/0055 482/121
2014/0323271 A1 10/2014 Hinds et al.
2016/0199697 A1 7/2016 Orfield
2016/0220863 A1 * 8/2016 Braier ..... A63B 23/16
2019/0290962 A1 * 9/2019 Osbrink ..... A63B 24/0062
2021/0077849 A1 * 3/2021 Wehrell ..... A63B 21/063
2021/0283457 A1 * 9/2021 Merritt ..... A63B 21/00069
2021/0370122 A1 * 12/2021 Mohieldin ..... A63B 21/0552
2022/0133198 A1 * 5/2022 Popov ..... A61B 5/1107 73/379.01
2022/0168608 A1 * 6/2022 Oltorik ..... A63B 21/4034
2022/0305336 A1 * 9/2022 Gable ..... G16H 15/00
2023/0110715 A1 * 4/2023 David ..... A63B 21/0557 482/121

(Continued)

*Primary Examiner* — Joshua T Kennedy
(74) *Attorney, Agent, or Firm* — Stratford Group Ltd.

(57) ABSTRACT

A fitness system includes two adjustable webbing attachment loops and a load cell device. The device comprises a casing that houses a load cell and a processor coupled to a non-transitory computer-readable medium and the load cell, configured to measure forces applied via the webbing loops. The loops are removably attached to the load cell in perpendicular orientations, each extending outward in the direction of force measurement. A load cell sensor portion is coupled to the processor. A first anchoring block is affixed to a first end of the sensor portion and includes two lateral protrusions extending from corresponding apertures in the casing, serving as attachment points for two adjustable webbing clasps. A first loop is secured via the clasps. A second anchoring block is affixed to the opposite end of the sensor portion, forming a space with the sensor portion to receive the second adjustable webbing attachment loop.

12 Claims, 10 Drawing Sheets

(56) References Cited

U.S. PATENT DOCUMENTS

| | | | | |
|---|---|---|---|---|
| 2023/0166156 | A1* | 6/2023 | Bar | A63B 21/00043 482/8 |
| 2024/0058636 | A1* | 2/2024 | Cupal | A63B 69/0048 |
| 2024/0123275 | A1* | 4/2024 | Norris | A63B 21/0442 |
| 2024/0245947 | A1* | 7/2024 | MacDonald | A63B 21/0442 |

* cited by examiner

INSTRUMENTED LOAD CELL DEVICE, FITNESS SYSTEM AND METHOD USING SAME

FIELD OF THE DISCLOSURE

This present disclosure relates to fitness training equipment and coaching software tools and, in particular, to an instrumented load cell fitness device, fitness system and method using same.

BACKGROUND

Resistance bands are widely known and used in fitness training. Regular strength training using a component of force generation exercises using resistance bands of the like directly relates to the total health profile of an individual.

There has been a proliferation of electronic instrumentation, coaching applications and data capture technology in the physical fitness field. There has not to this point been a satisfactory instrumentation or data capture approach developed for use with resistance band exercises. It is believed that if such a product did exist it would be widely accepted in the physical fitness industry.

Many types of muscle conditioning and strengthening exercises use resistance bands tethered at one end to other equipment in the gym or fitness training area with the other end of the band being engaged by the user. One of the metrics which it is believed can be used in this regard is to track the accumulated force produced by an individual throughout their training session. If it were possible to capture this information using a sensor this would be far more accurate and more easily accomplished for an individual than trying to monitor or calculate this type of a metric with respect to a manual workout.

It is further believed that if it were possible for an individual to see from an instrument display during their work out the amount of force being produced at a particular time from their use of a resistance band this would be motivational in terms of completing a good workout. If it were possible to provide a load cell that allowed for the display during a workout of the amount of force being generated by an individual at a particular time it is believed that this would also be significant and commercially accepted.

This background information is provided to reveal information believed by the applicant to be of possible relevance. No admission is necessarily intended, nor should be construed, that any of the preceding information constitutes prior art or forms part of the general common knowledge in the relevant art.

BRIEF SUMMARY

The following presents a simplified summary of the general inventive concept(s) described herein to provide a basic understanding of some aspects of the disclosure. This summary is not an extensive overview of the disclosure. It is not intended to restrict key or critical elements of embodiments of the disclosure or to delineate their scope beyond that which is explicitly or implicitly described by the following description and claims.

In accordance with one aspect, there is provided a fitness system, comprising: a load cell device comprising: a casing; a load cell fittingly housed within said casing; one or more attachment means for removably attaching two adjustable webbing attachment loops to the load cell oriented perpendicular to each other, each loop extending, when installed, outward from the device in the direction of force measurement; and a processor coupled to a non-transitory computer-readable medium and the load cell and configured to measure a force applied on the load cell by the two adjustable webbing attachment loops.

In some embodiments, a first attachment loop of said one or more attachment loops is attached via two adjustable webbing clasps.

In some embodiments, the load cell comprises: a load cell sensor portion coupled to the processor; a first anchoring block affixed at a first end of the load cell sensor portion, the first anchoring block comprising at two opposite ends thereof a protrusion extending outwardly laterally from a corresponding lateral aperture in the casing to serve as an attachment point for each adjustable webbing clasp; and a second anchoring block affixed at a second end of the load cell sensor portion, opposite the first anchoring block, the second anchoring block and the load cell sensor portion defining a space therebetween for receiving a second loop of said one or more loops.

In some embodiments, the second anchoring block has a substantially rounded surface opposite the load cell sensor portion for engaging the second loop thereon when force is applied.

In some embodiments, the device further comprises a wireless networking module communicatively coupled to the processor, and configured to communicate force-related data to a user device.

In some embodiments, the system further comprises an exercise bar comprising an elongated body comprising along a length thereof one or more markings for hand placement; and a coupling means at one end of said body to removably couple the exercise bar to one of the attachment loops so as to provide targeted torque resistance.

In some embodiments, the one or more markings comprise: a center marking; and one or more pairs of secondary markings, each pair of secondary markings being located on opposite sides of the center marking and equidistantly spaced from the center marking.

In some embodiments, the coupling means is an eyelet extending outwardly from said end parallel to said length.

In some embodiments, the non-transitory computer-readable medium comprises instructions that, when executed, cause the processor to at least: receive force-related data from the load cell; identify one or more peak in the force-related data; and evaluate the one or more peak against one or more predefined criteria by: identifying one or more peak value exceeding a threshold or being smaller than a designated ratio of a total peak weight.

In some embodiments, the load cell device further comprises a digital display communicatively coupled to the processor, and wherein the instructions further causing the processor to at least display at least the peak value on the digital display.

In some embodiments, the system further comprises a user device communicatively coupled to the load cell device via one or more networks, the user device comprising a user interface, the user device receiving said identified peak value from said load cell device for tracking performance.

In some embodiments, the user device comprises a second processor coupled to a second non-transitory computer-readable medium comprising instructions that, when executed by the second processor, cause the second processor to at least: display a list of exercises to be performed by the load cell device by a user; receive, by the user via the user interface, a selection of one or more exercises from the list; prescribe, based on the selection, an effort per repetition and an accumulated force generation goal; and track a realization of said effort per repetition or accumulated force generation goal based on said identified peak values.

In some embodiments, the accumulated force generation goal is calculated per exercise set, per workout, within a set number of workouts or within a fixed timeline.

In some embodiments, the effort per repetitions comprises at least one of: a minimum effort per repetition or a maximum effort per repetition.

Other aspects, features and/or advantages will become more apparent upon reading of the following non-restrictive description of specific embodiments thereof, given by way of example only with reference to the accompanying drawings.

BRIEF DESCRIPTION OF THE DRAWINGS

Several embodiments of the present disclosure will be provided, by way of examples only, with reference to the appended drawings, wherein.

Figure 1A:
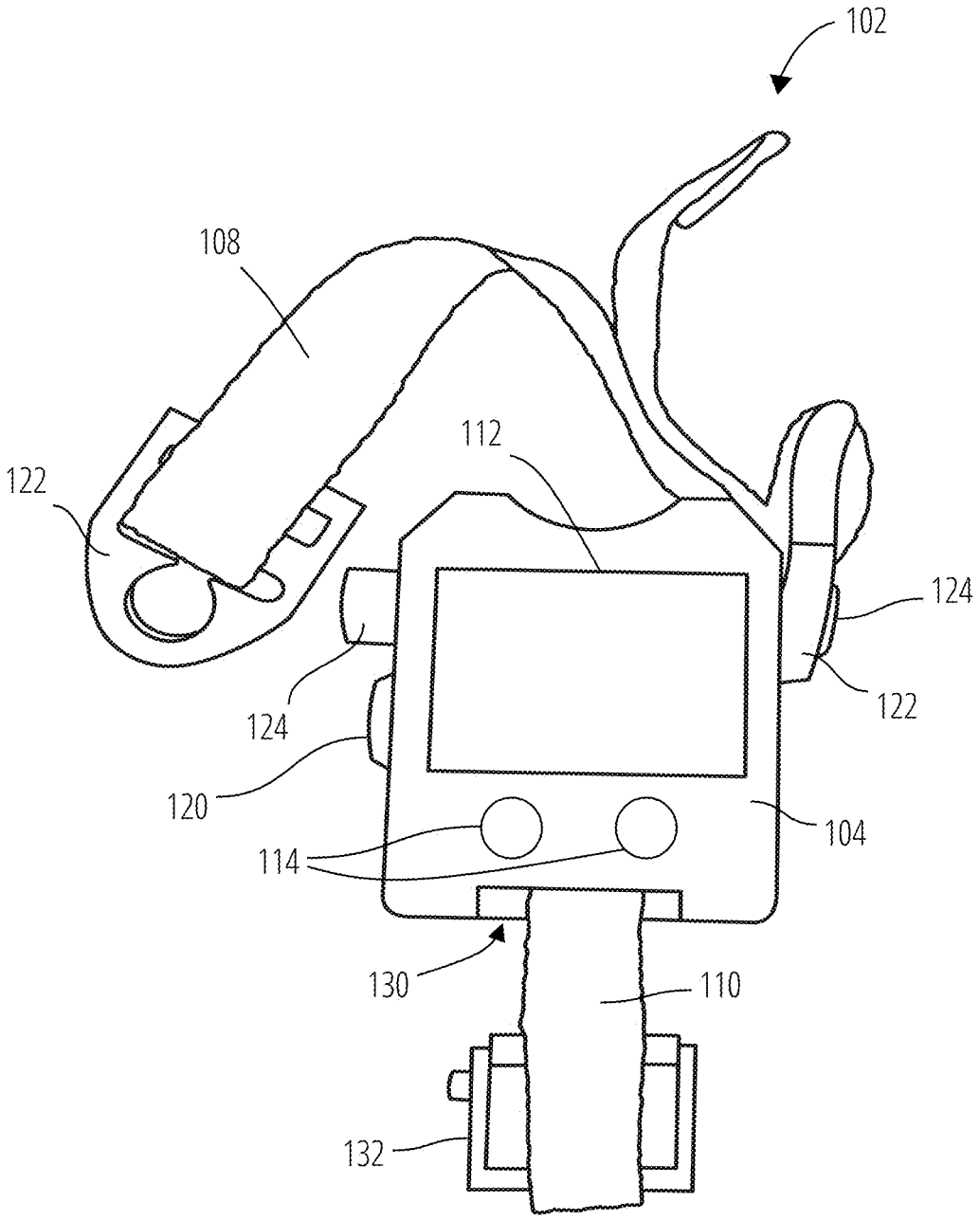
FIG. 1A is a front view of a load cell device, in accordance with one embodiment.

Elements in the several drawings are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood elements that are useful or necessary in commercially feasible embodiments are often not depicted in order to facilitate a less obstructed view of these various embodiments of the present disclosure.

DETAILED DESCRIPTION

Various implementations and aspects of the specification will be described with reference to details discussed below. The following description and drawings are illustrative of the specification and are not to be construed as limiting the specification. Numerous specific details are described to provide a thorough understanding of various implementations of the present specification. However, in certain instances, well-known or conventional details are not described in order to provide a concise discussion of implementations of the present specification.

Furthermore, numerous specific details are set forth in order to provide a thorough understanding of the implementations described herein. However, it will be understood by those skilled in the relevant arts that the implementations described herein may be practiced without these specific details. In other instances, well-known methods, procedures and components have not been described in detail so as not to obscure the implementations described herein.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of." The phrase "one or more of the following: A, B, and C" means "at least one of A and/or at least one of B and/or at least one of C."

The present disclosure is directed, in accordance with different embodiments, to a portable instrumented load cell device for use in fitness training applications in conjunction with resistance bands or other force generation training equipment. It will be understood that resistance bands are a primary use, but other types of force generation equipment with which it could be used include exercise cable pulleys, weights and the like. The adaptability of the instrumented load cell of the present disclosure permitting its use or attachment to various types of force generation equipment is one aspect of the novelty of the present disclosure. The load cell device is further configured to be used in conjunction with a fitness system comprising a dedicated fitness application, and add-ons, such as a training bar.

Figure 1B:
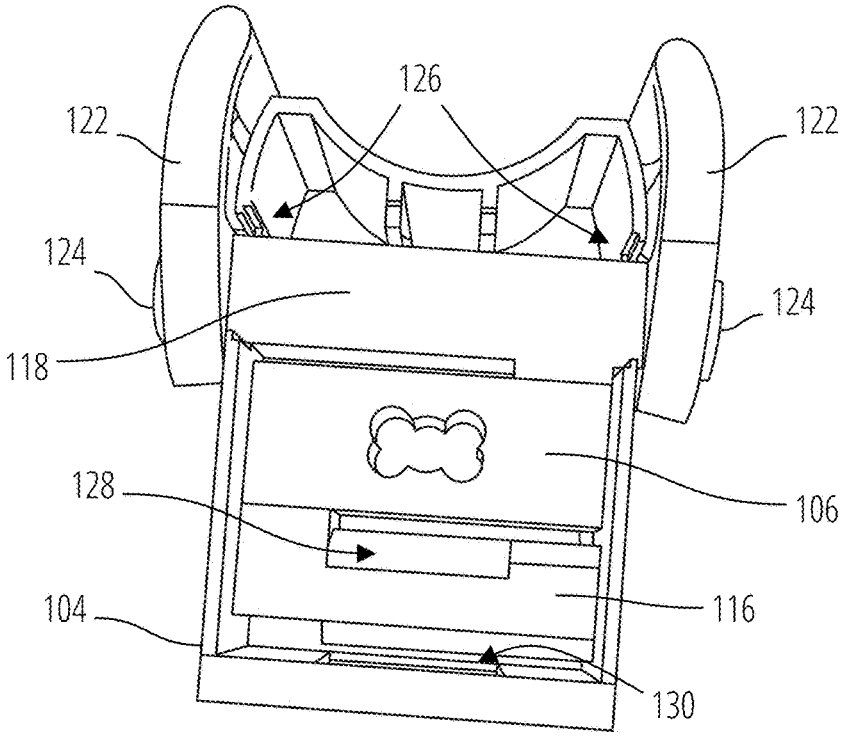
FIG. 1B is a front view of the load cell device of FIG. 1A with the casing cover removed, in accordance with one embodiment.
Figure 2:
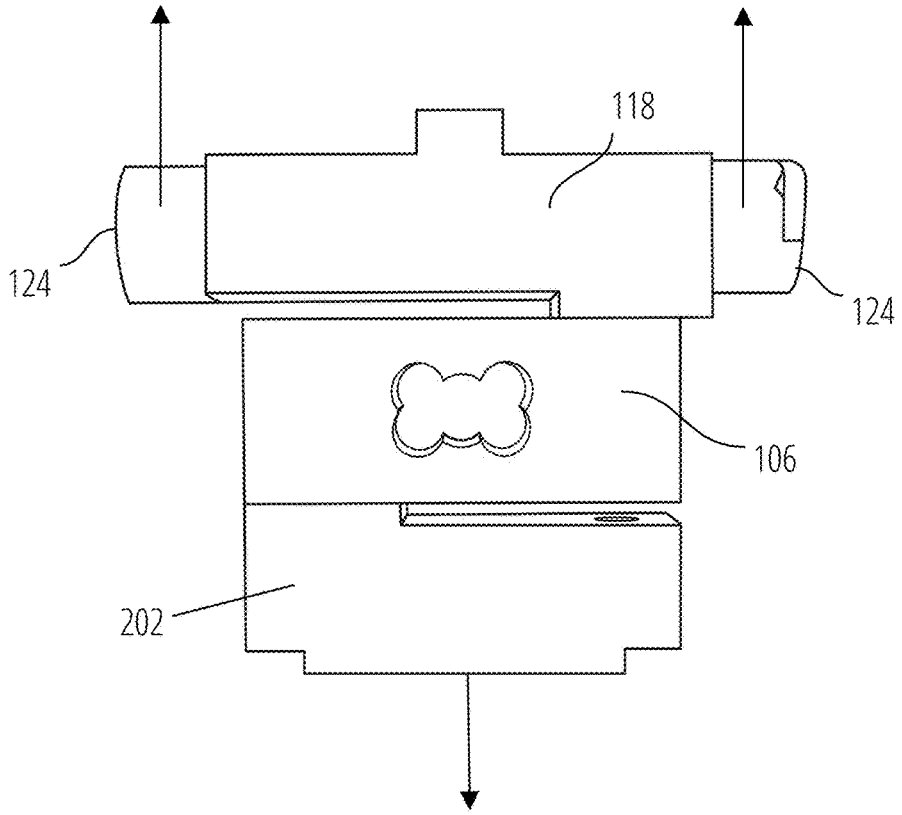
FIG. 2 is a schematic force diagram on the load cell sensor and anchoring blocks in accordance with one embodiment.
Figure 3A:
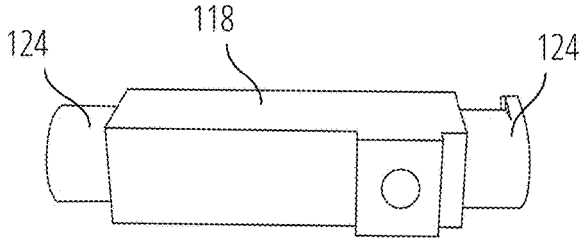
FIG. 3A, FIG. 3B, FIG. 3C and FIG. 4A are different perspective views of the first anchoring block of the load cell, in accordance with one embodiment.
Figure 3B:
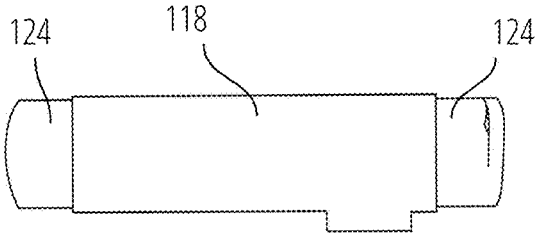
Figure 3C:
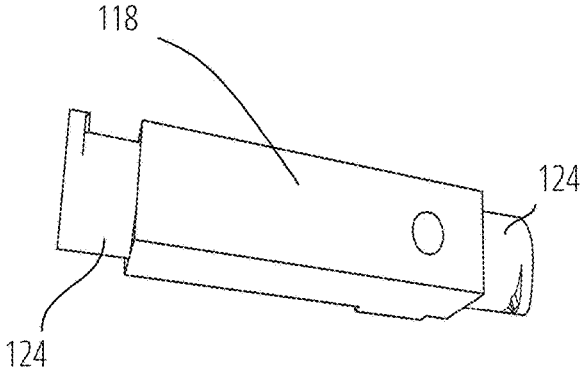
Figure 4A:
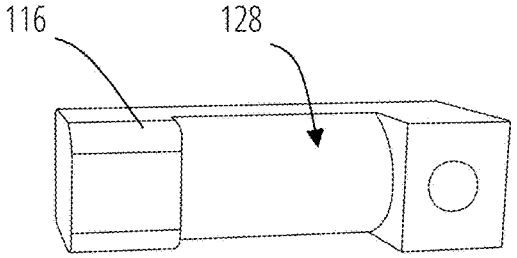
Figure 4B:
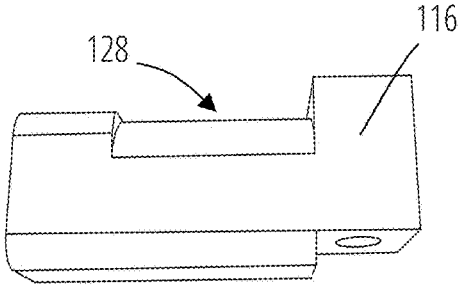
FIG. 4B, FIG. 4C, and FIG. 4D are different perspective views of the second anchoring block of the load cell, in accordance with one embodiment.
Figure 4C:
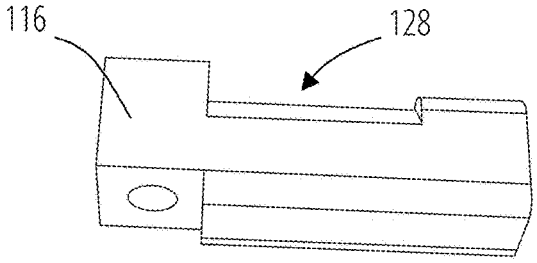
Figure 4D:
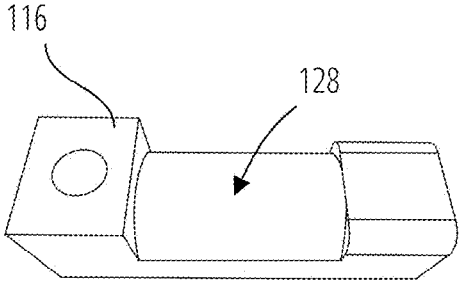

With reference to FIGS. 1A-1B and FIG. 2, a load cell device 102 will now be described, in accordance with one embodiment. The load cell device 102 comprises a casing 104 for housing a load cell or load cell sensor 106. The device 102 is configured to be removably coupled to attachment loops 108 and 110. The front portion of the casing 104 comprises a digital display 112 to provide measurement outputs and other fitness related variables, and one or more buttons 114 to receive configurational inputs from the user. The illustrated shape, size and placement of the digital display 112 and buttons 114 is exemplary only and it will be appreciated that other configurations may be used without limitation.

FIG. 1B illustrates the load cell device 102 with the top cover of the casing 104 removed to present a view of the internal load cell 106 and the two anchoring blocks 116 and 118. The concept of a load cell sensor is understood by those skilled in the art. The load cell 106 can measure the force applied by a particular load by in-line attachment at two ends to an anchor point and the load. Each end of the load sensor further comprises an anchoring block 116 and 118, which can be attached to the anchor point and/or the tension system for use of the device. In some embodiments, a side port 120 (such as a USB port or the like) may also be provided to allow data exchange with the device 102.

Figure 5A:
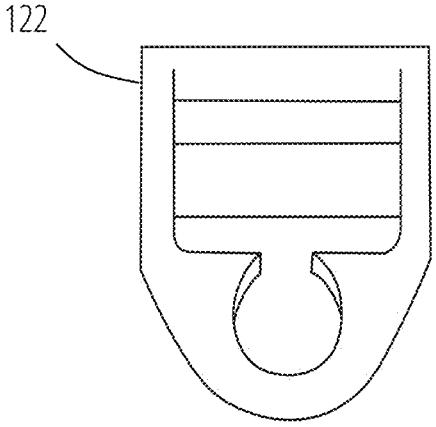
FIG. 5A, FIG. 5B, and FIG. 5C are different views of an adjustable webbing clasp, in accordance with one embodiment.
Figure 5B:
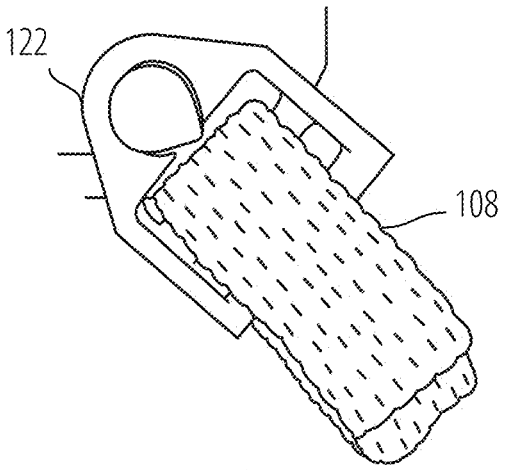
Figure 5C:
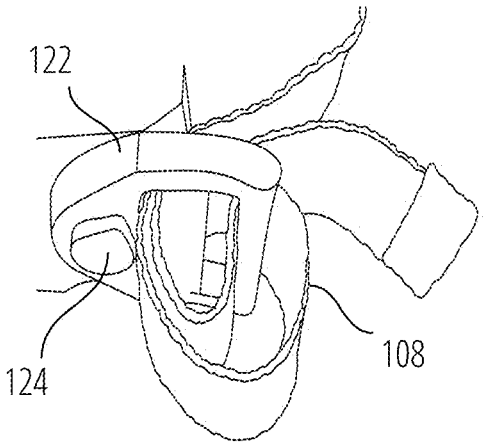

At a first end of the load sensor 106, with its corresponding anchoring block 118, a first attachment loop 108 comprised of webbing can be attached thereto via adjustable webbing clasps 122. This permits the attachment and adjustment of the device 102 to anchor point via a web loop. FIG. 1A and FIG. 1B show the adjustable webbing clasps 122 attached at each end 124 of the load cell first anchoring block 118. The anchoring block ends 124 of the first anchoring block 118 extend laterally outwardly from the casing 104 via two side apertures 126. FIG. 5A, FIG. 5B and FIG. 5C show close-ups of the clasp 122 alone, engaged with the first attachment loop 108 and coupled to the anchoring block end 124, respectively. When attached, the first attachment loop 108 comprised of webbing will engage the adjustable webbing clasps 122 in approximately a direction perpendicular to the axis of force measurement. At the second end of the load cell, a second attachment loop 110 can be attached extending outwards therefrom, in approximately the direction of force measurement of the load cell. The second attachment loop 110 is configured to be interchanged or installed during assembly by sliding it into position through the access slot defined between the load cell 106 and second anchoring block 116, so as to engage the rounded top surface 128 of the second anchoring block 116 and extend outwardly via the aperture 130 in the casing 104. FIG. 2 shows a diagram illustrating the application of force to the load cell when under load, with another embodiment of the second anchoring block 202 being shown as an example only.

Figure 6:
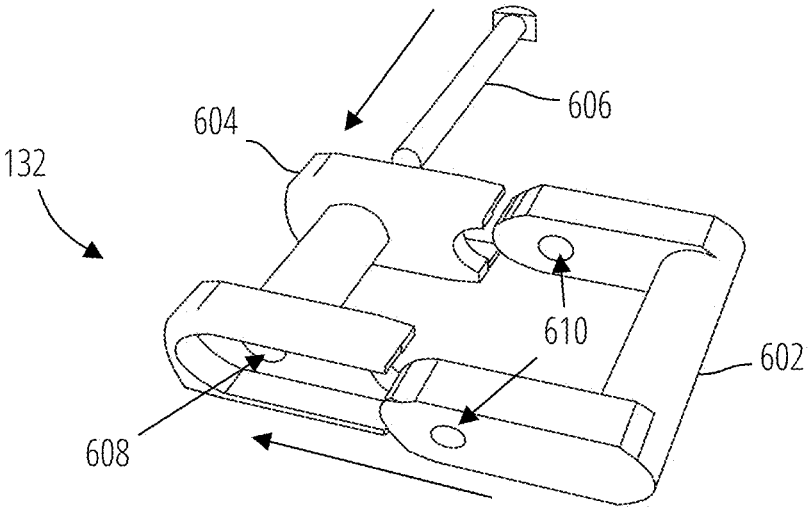
FIG. 6 is an exploded view of a clasp, in accordance with one embodiment.

The first attachment loop 108 is and second attachment loop 110 are configured purposefully to be approximately perpendicular to each other to maximize the utility of the device. The second attachment loop 110 will be used to attach the resistance band or other fitness equipment from which force will be measured. The force tension diagram FIG. 2 shows, without the casing 104, the configuration of the key anchoring elements of the device 102 and how the force when applied by a resistance band or other equipment attached at the left-hand anchor in the figure can be measured. The second attachment loop 110 is shown attached at one end thereof to a clasp 132. In some embodiments, the clasp 132 may be provided as parts to be assembled by the user. FIG. 6 shows an example of a clasp 132 comprising a first portion 602, a second portion 604 and a fastening means like a pin 606. The pin 606 engages the apertures 608 and 610 of the first portion and second portion, respectively, during assembly (as shown by the arrows). The second attachment loop 110 is attached to the clasp 132 with a fixed loop around the first portion 602 at one end and the second portion 604 at the other. Both are fixed.

As mentioned above, the load cell device 102 includes a digital display 112 with power supply, which will digitally display the amount of force being generated by an individual at a particular time during the use of a resistance band attached to the load cell device 102 and a fixed attachment point. Any number of different types of digital displays will be understood to be contemplated within the scope of the present disclosure along with the necessary onboard hardware to capture the force generation reading from the load cell for display on the digital display, and/or for communication to a connected device for further processing or storage. Any type of digital display and related controller hardware associated therewith which can achieve this approach will be understood to be within the scope of the present disclosure.

Figure 7:
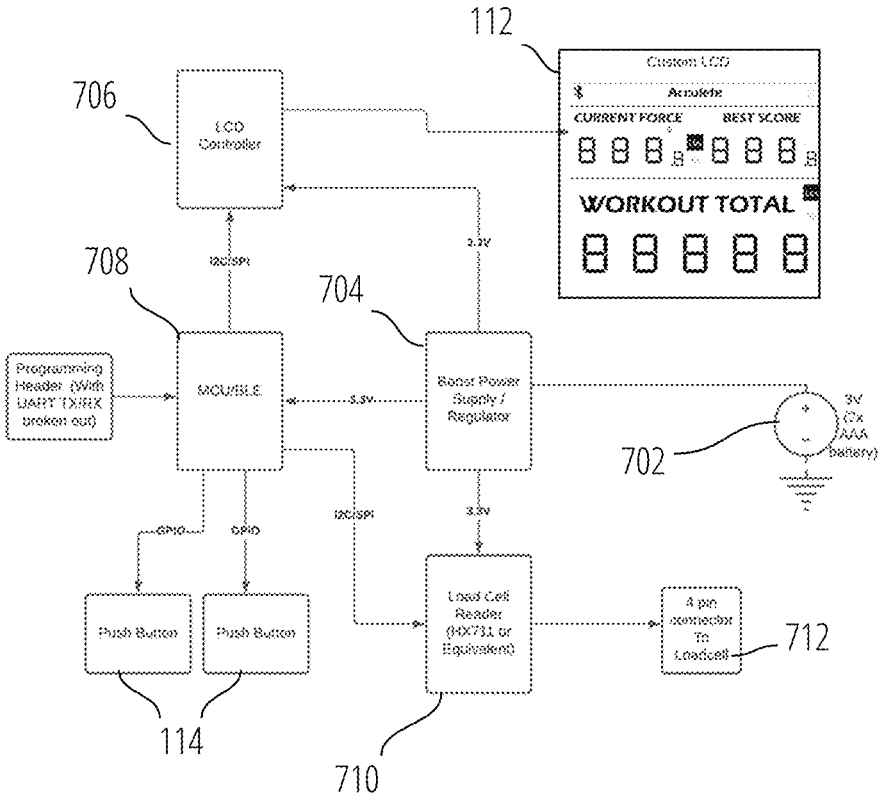
FIG. 7 is a schematic diagram of the electronic components of the load device, in accordance with one embodiment.

FIG. 7 shows an exemplary schematic diagram of the internal electronic components of the device 132. In this example, the device 132 comprises a power source 702, for example 2 AAA batteries (although other types of rechargeable or non-rechargeable batteries may also be used), coupled to a power supply/regulator 704. In some embodiments, the power source 702 may be a rechargeable battery that can be recharged via a USB connector and/or wirelessly. The power supply 704 is further connected to the display controller 706, to a network-enabled processing module 708 (such as a Bluetooth® LE embedded module like the CYBLE-416045 Module, or equivalent) and the load cell reader 710 (for example an HX711 or equivalent) and measurements from the load cell 106 are acquired via the loadcell reader 710, which is connected to the load cell via one or more connectors 712 (for example a 4-pin connector or equivalent). In some embodiments, the device may further include one or more physical buttons 114 to receive inputs from the user. In this example, the illustrated two momentary push buttons 114 are connected to integrated through GPIO, with pull up resistors. The buttons may include an off/on switch to avoid the batteries between depleted when the device 102 is not in use, and a reset button to reset the display.

Figure 8:
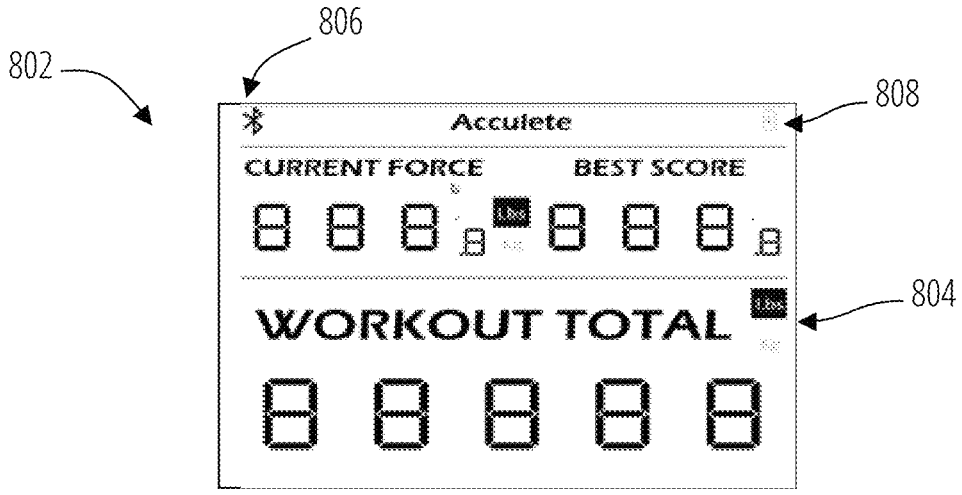
FIG. 8 is a schematic diagram of an exemplary user display, in accordance with one embodiment.

FIG. 8 is an exemplary user display 802 presented to the user via the digital display 112. In this example, parameters shown to the user include the current force measured by the load cell device 102, a best score value and a workout total value. Other features may include a weight unit indicator 804, a Bluetooth connection indicator 806 and a battery indicator 808. In some embodiments, the reset button may be used to reset the displayed best score value. In some embodiments, pushing a button repeatedly during a short time, and/or holding a button for a designated duration may also provide different functionalities. For example, in one embodiment, pushing a button for three seconds and releasing it clears the accumulation score, and/or pushing and holding a button for 10 seconds will trigger a calibration mode so that the device 102 may be calibrated.

Figure 9:
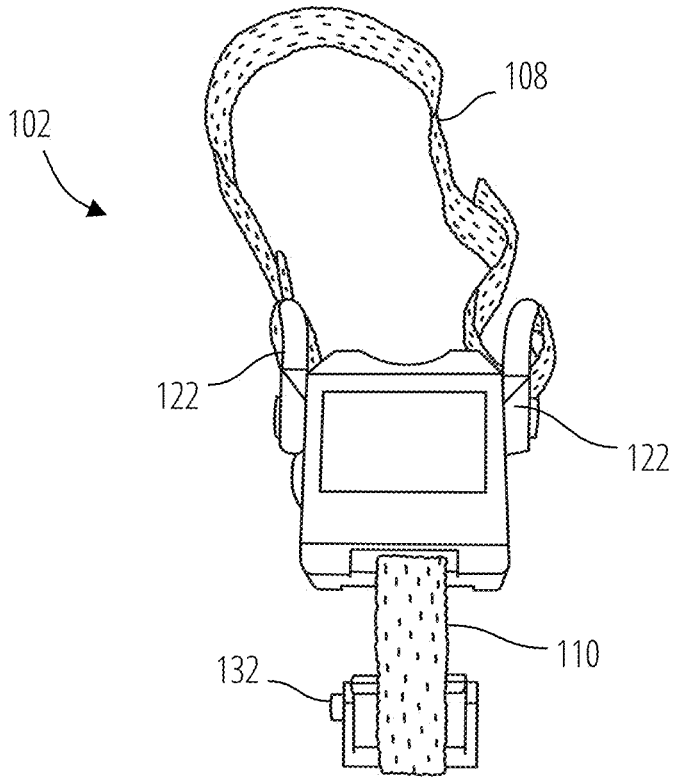
FIG. 9 is another front view of the load cell device, in accordance with one embodiment.

FIG. 9 shows another drawing of the load cell device 102, in accordance with one embodiment of the present disclosure, with the webbing attachment loops attached. The first attachment loop 108 and the second attachment loop 110 are adjustable in size and length to accommodate the particular anchor point or the particular required attachment parameters to the fitness equipment.

Figure 10:
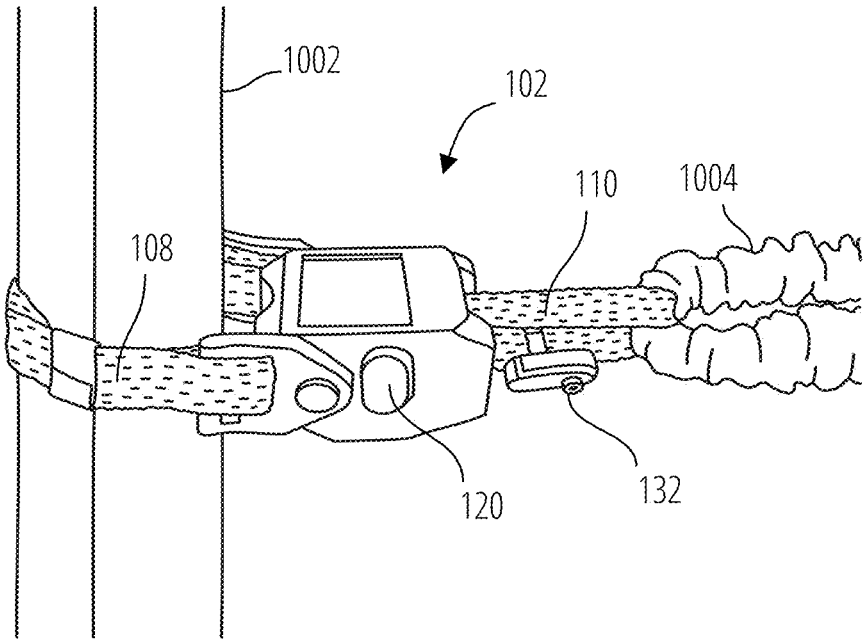
FIG. 10 is a perspective view of the load cell device removably attached to a pole, accordance with one embodiment.
Figure 11:
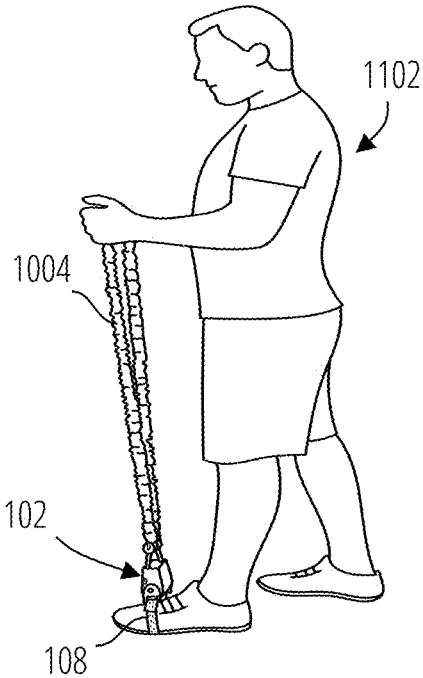
FIGS. 11-15 are side views of the load cell device being used by a user in different configurations, in accordance with different embodiment.
Figure 12:
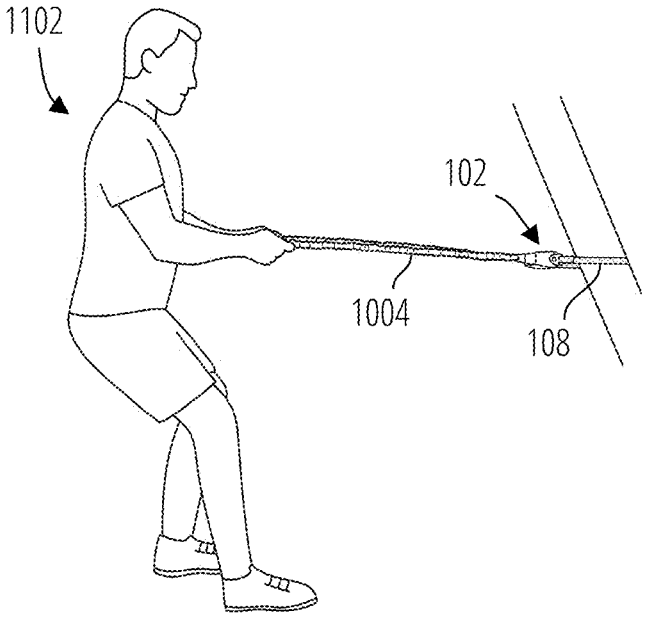
Figure 13:
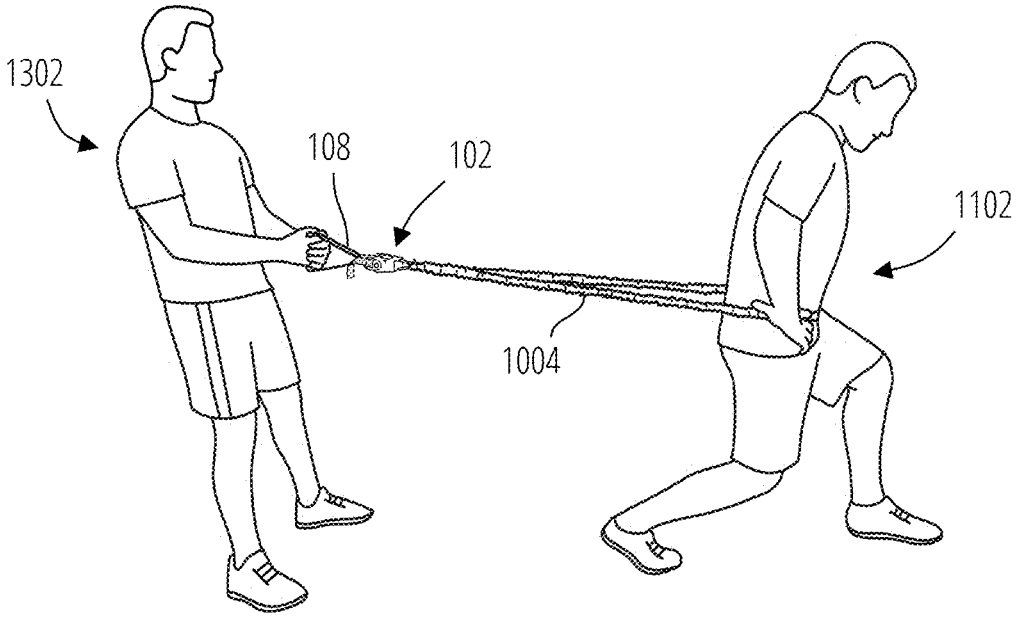
Figure 15:
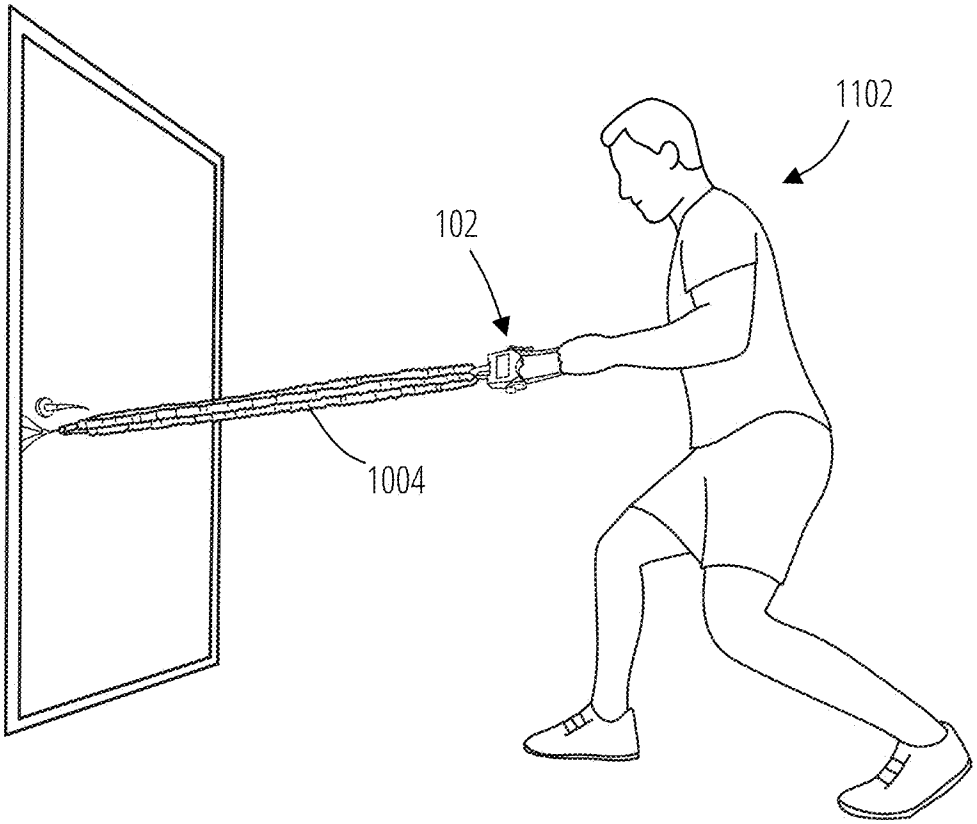
Figure 14:
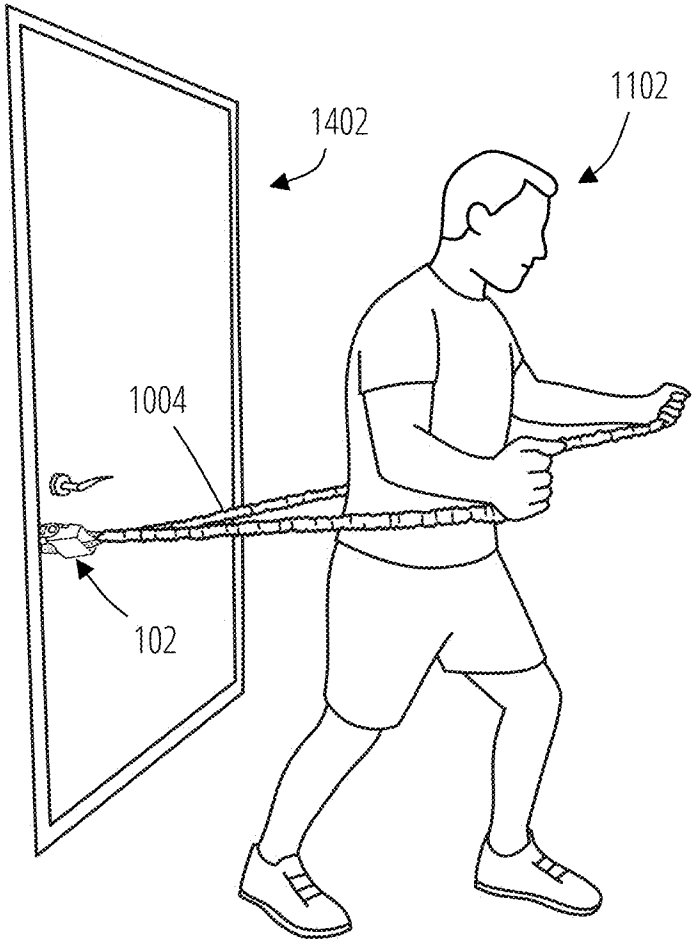

A method of use of the device is also disclosed, in accordance with different embodiments. Typically, as shown in FIG. 10, the device 102 is anchored to an anchor point (post or column 1002) and engaged by the fitness user by use of a resistance band 1004 or other tension apparatus. FIGS. 11-15 show various examples of how the device 102 may be used by a fitness user 1102 in accordance with different configurations. Notably, FIG. 13 shows how a second user 1302 (e.g., a trainer or person providing assistance) may be used to provide the anchor point, while FIG. 14 and FIG. 15 illustrate two examples where a closed door 1402 is used as an anchor point, by affixing the loops or elastic bands between the closed door and the jamb.

In addition to the digital display 112 which can show the force being generated or produced by the user at a particular time, the load cell device 102 may also include a network interface via which data can be captured from the digital display and related electronic hardware of the instrumented load cell to a software application on a separate electronic device or user device 1602—such as a smart phone, computer or smart device of the user etc. the network interface as will be understood to those skilled in the art could be an interface to any number of different types of network topologies which would permit communication between the instrumented load cell and the device of the user—including Wi-Fi, Bluetooth and other types of network architectures and interfaces all of which will be understood to be contemplated within the scope of the present disclosure.

Figure 16:
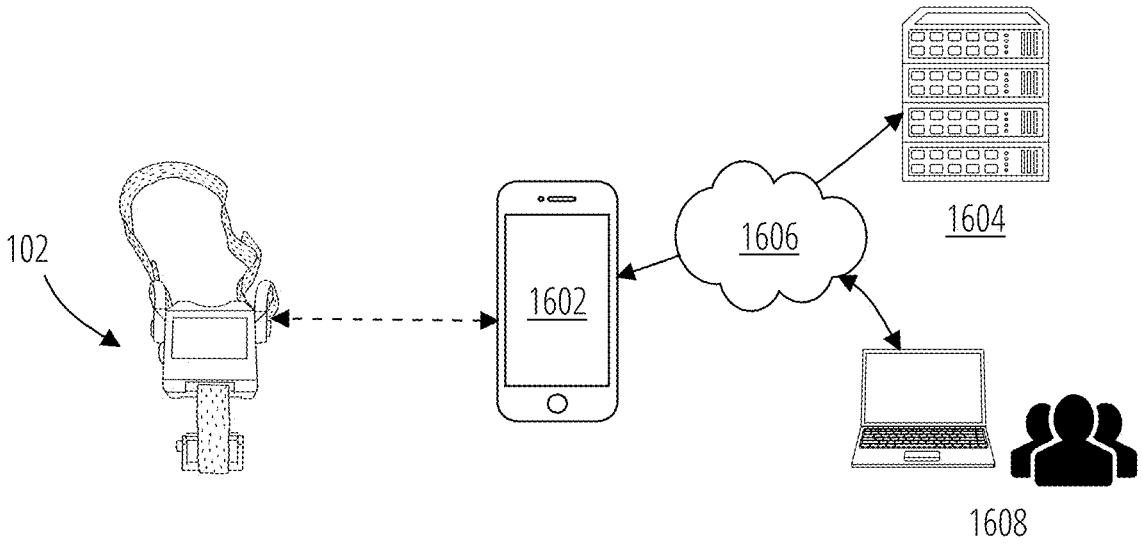
FIG. 16 is a schematic diagram of a fitness system comprising the load cell device, a user device and a server, in accordance with one embodiment.
Figure 17:
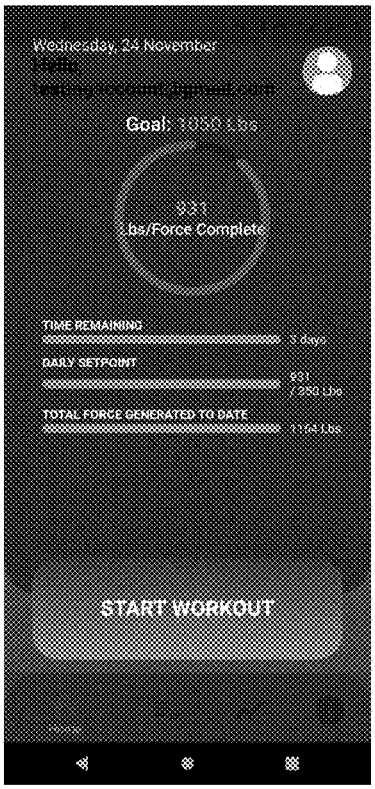
FIG. 17 is a photograph of an exemplary user interface display, in accordance with one embodiment.

The disclosure also comprises a software application for use on a computer or a mobile device 1602 which allows for the display of information from the instrumented load cell, in network communication therewith, as well as permitting long-term record-keeping of accumulated force produced throughout one or more training sessions. The software application will allow the user to set and track long-term force generation goals, which directly relates to their total health profile since regular strength training is important for long-term health. As illustrated in FIG. 16, a remote server 1604 communicatively coupled to a user device 1602 via one or more networks 1606 may also be used, for example to provide a user profile database or the like. In some embodiments, data associated with the user may be accessible to one or more prescribing practitioners 1608 to allow them to assess the user's performance and improvements. In some other embodiments, the system may allow partial or full offline functionality, and thus not require, or require in a limited fashion, the server 1604. FIG. 17 shows an exemplary user interface generated by the application and displayed on the user device 1602.

It is explicitly contemplated that the device and method along with the software of the present disclosure would allow for the instantaneous display of current force being generated or applied by the user, as well as tracking total amounts of force generated within a particular workout session or overall program longer period of time. All such approaches are contemplated within the scope of the present disclosure.

Peak Detection

In some embodiments, instructions stored on a non-transitory computer-readable medium may be configured to perform an efficient peak detection algorithm to identify peaks in weight measurements. The weight measurements acquired by the load sensor are analyzed to determine if a peak is detected. If a peak is detected, the system evaluates the peak value against one or more predefined criteria. If the peak value exceeds a threshold or falls below a certain ratio of the total peak weight, it is considered valid. Otherwise the peak detection flag is reset. Valid peaks contribute to the total weight measured by the device.

In one non-limiting example, the pkDet_ProcessNew Value function integrates the simplePeakDetect algorithm to detect peaks in a signal represented by the currentValue by performing the following steps:

1. Initialization:
   It initializes isPeakDetected to false and peak Value to 0.0.
1. Peak Detection:
   It calls the simplePeakDetect function with the currentValue, lastWeightValue, &isPeakDetected, and &peak Value.
1. Peak Handling:
   If a peak is detected (isPeakDetected is true):
   It compares peak Value with totalPeakWeight.
   If peakValue is greater than totalPeakWeight, it updates totalPeakWeight with the new peak value.
   If peak Value is less than a fraction (sAlgoConfig.fPeakLastPeakRatio) of totalPeakWeight, it resets isPeakDetected to false.
   If isPeakDetected remains true after the above checks, it increments totalWeight by peak Value.
1. It resets powerDownTimer to 0.
2. Update Last Value:
3. It updates lastWeightValue with the currentValue.
4. State Updates:
   It updates various states such as sCurrentState.u32CurrentValue, sCurrentState.u32MaxValue, sCurrentState.u32TotalMoved, and sCurrentState.u32Status based on the current values of currentValue, totalPeakWeight, totalWeight, and a constant value.

Overall, the pkDet_ProcessNew Value function processes incoming values, detects peaks using simplePeakDetect, and updates relevant state variables accordingly. It also handles peak value comparisons and updates to ensure accurate peak tracking and state maintenance.

In one non-limiting example, the simplePeakDetect function performs the steps of:

1. Initialization:
   a. initializes variables including num_upsteps, possible_valley, value_possible_valley, possible_peak, and value_possible_peak. num_upsteps counts consecutive upward steps in the signal. The variables possible_valley and possible_peak flags indicate whether a valley or a peak is potentially detected. The variables value_possible_valley and value_possible_peak store the values of the potential valley and peak, respectively.
2. Peak detection:
   a. If newSample is greater than lastSample, it increments num_upsteps and checks for a potential valley. If possible_valley is false, it sets possible_valley to true and stores the value of lastSample in value_possible_valley.
   b. If newSample is not greater than lastSample, it checks if num_upsteps exceeds a threshold (threshold_peak). If so, it sets possible_peak to true and stores the value of lastSample in value_possible_peak.
   c. If neither condition is met, it updates value_possible_valley if newSample is less than or equal to it and updates value_peak if lastSample is greater than value_possible_peak.
   d. If a peak is detected (possible_peak is true), it updates *peakFound and *peak Value with the peak's value (value_peak). It also updates value_valley if possible_valley is true and resets possible_valley, num_upsteps, and threshold_peak.

3. Threshold Update:
   a. It updates threshold_peak based on sAlgoConfig.fDecayThreshold and num_upsteps.

Overall, the algorithm presented above iteratively processes input samples to detect peaks in the signal while dynamically adjusting threshold values for peak detection. It will be appreciated that the algorithms described above are presented in accordance with one non-limiting implementation only, using exemplary variable names, and that other implementations may be used as well to perform the same method.

Prescription Model

In accordance with different exemplary embodiments, a computer-implemented exercise prescription model or method for use with the device and system of the present disclosure will now be described. In contrast with typical strengthening methods prescribing strengthening exercises using sets and repetition ranges, the present method prescribes an effort per repetition and an accumulated force generation goal per exercise set, per workout and within a set number of workouts and/or a fixed timeline. Non-limiting examples of prescriptions that can be measured/tracked with the device and system of the present disclosure include:

a minimum effort per repetition;
a maximum effort per repetition;
an accumulated force generation per set;
an accumulated force generation for all sets of an exercise; and/or.
an accumulated force generation for all the exercises in a workout session.

In some embodiments, the method of use may also measure and track accumulated force scores for long-term accountability and motivation. This may include:

1. an accumulated force generation for a set number of workouts; and/or
2. an accumulated force generation over a set period of time.

The set period of time may include any duration or time period, for example a week or a set number of weeks. This provides the advantage of allowing users to have the freedom to self-guide workouts as long as they reach the target accumulated force for that time period.

The exemplary prescription model is based, at least in part, on an amount of work a user needs to do to be successful. The measured amount of work (i.e., force generated) is processed by the user device and/or server's processing module and compared to the set goal to assess progress.

In some embodiments, the user may set a new goal as follows:

Exercise Assessment

1. The sets the appropriate level of effort per repetition is evaluated and expressed in single effort force generation.
2. The appropriate amount of accumulated force per set to ensure success is evaluated.

Goal Prescription

3. The accumulated force per exercises to get an accumulated force goal per workout is evaluated (this step may be done manually by the user, or automatically by the application). The goal may be logged at any time (complete or incomplete), and the user's history page on the application displays all logged goals.

Tracking the Goal in the Application 4. the user may choose a timeline (date specific);
5. the user may choose a number of workouts to be completed in that timeline;
6. the user may select the exercises for that workout. In some embodiments, a library of exercises may be provided to the user for selection. The user may create new ones or add "un-named" exercises via a graphical user interface (GUI) on their user device. The force accumulation per set and the number of sets per exercise may also be added.
7. the user may choose an order in which to execute the exercises;
8. the user may select a post workout processing choice. This may include for example:
   a. Fixed: all per set and per exercise accumulation goals remain as originally set; or
   b. Auto-adjusted: the accumulated force per exercise is divided by the number of sets and the resultant is the new accumulation goal per set. The per workout accumulation score is appropriately adjusted.

Once all the information has been entered, the user may click or select the "submit" button.

Accountability Tracking

To track the goal, the following steps are performed:

9. The application can display a total force generated to date towards the accumulation goal.
10. The user opens the workout page or similar.
11. The user activates the load cell device.
12. The user selects the "start workout" button.
13. The user selects a workout (from multiple workouts on the go).
14. The first exercise of the selected workout is displayed to the user. The user executes the exercise while the application records the effort and force accumulation. In some embodiments, the application may track the force accumulation for that set and alert the user when the set is completed.
15. The user may select the next exercise, for example via a swiping gesture or other. The application records the actual force accumulated for the exercise that was completed whether the set goal was incomplete, complete or exceeded.
16. The application alerts the user that the workout is completed upon two parameters being met:
    a. all per exercise force accumulation have been attained; and
    b. the total force accumulation for the workout is attained.
17. The user can log the workout at any time (completed or not);
18. The application updates the accumulated force towards that goal.

It will be appreciated that multiple workout goals can be displayed on the home page of the application on the user device. In addition, a remove prescribing practitioner (e.g., practitioner 1608) may see a user's current progress towards a timeline goal, number of workouts attempted and/or completed as well as any logged goals.

Torque Bar

Figure 18:
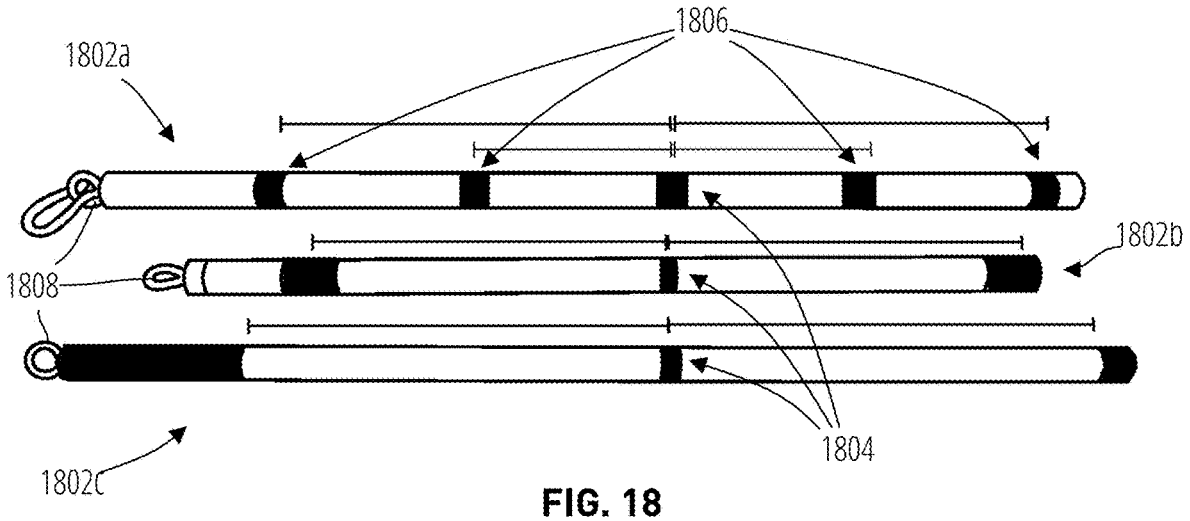
FIG. 18 is a side view of different marked exercise bars, in accordance with different embodiments.
Figure 19:
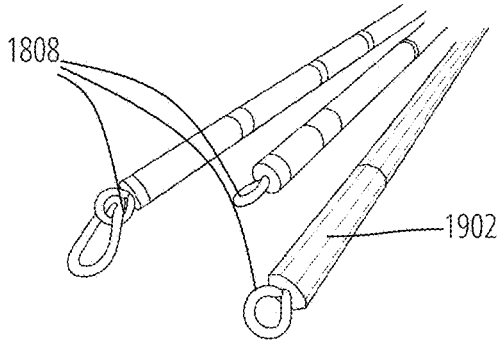
FIG. 19 is a perspective view of different marked exercise bars, in accordance with different embodiments.
Figure 20:
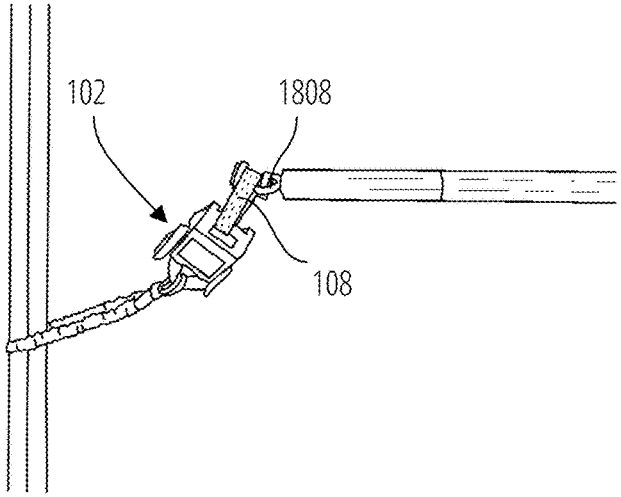
FIG. 20 is a side view of the exercise bar attached to the load cell device, in accordance with one embodiment.

In some embodiments, the load cell device 102 may be used in conjunction with one or more accessories. With reference to FIG. 18, FIG. 19 and FIG. 20, an adjustable torque-resistant exercise bar 1802 will now be described, in accordance with different embodiments. FIG. 18 and FIG. 19 show three exemplary embodiments 1802*a*, 1802*b* and 1802*c* of an exercise bar that can be used in combination with the load cell device 102. The exercise bar 1802 comprises one or more measured markings or lines along its length to measure hand placement and maintain consistent body alignment throughout workout routines. This feature enhances the effectiveness of exercises targeting specific muscle groups and allows for versatile use in various workout routines, including golf swing drills and chop drills. In addition, the measured lines on the bar provide a way to ensure the torque forces are repeatable and/or consistent.

As shown in these non-limiting examples, the markings or lines may include a center marker 1804 and two or more equidistant markers 1806 on each side thereof. These markings facilitate accurate hand placement and ensure proper body alignment during exercises. This is in contrast with traditional exercise bars that lack the ability to provide targeted torque resistance for users, limiting their effectiveness in certain workout routines. Markings may have different widths/lengths as illustrated in FIG. 18.

The bar 1802 may also include at one end thereof a strong eyelet 1808 to serve as a secure attachment point for resistance bands and/or exercise cables, allowing targeted torque resistance during workouts (as illustrated for example in FIG. 20). The bar is configured so that when it is held horizontally and parallel to the user's body, the asymmetric resistance applied by the attached bands or cables creates a torque force, which varies based on the width of hand placement on the bar.

In some embodiments, the bar's surface may be rounded and smooth, or in other embodiments have a polygonal transversal sectional shape 1902 as shown in FIG. 19. In some embodiments, the bar's surface may comprise one or more additional material layers, such as rubber or plastics, to improve the user's grip or the like. The bar may be manufactured from a hard and strong material, such as wood, plastic or metal, or any combination thereof.

The present disclosure includes systems having processors to provide various functionality to process information, and to determine results based on inputs. The processors may be adapted to perform operations specified by a computer-executable code, which may be stored on a computer readable medium.

The steps of the methods described herein may be achieved via an appropriate programmable processing device or an on-board field programmable gate array (FPGA) or digital signal processor (DSP), that executes software, or stored instructions. In general, physical processors and/or machines employed by embodiments of the present disclosure for any processing or evaluation may include one or more networked or non-networked general purpose computer systems, microprocessors, micro-controllers, and the like, programmed according to the teachings of the exemplary embodiments discussed above and appreciated by those skilled in the computer and software arts.

Stored on any one or a combination of computer readable media, the exemplary embodiments of the present invention may include software for controlling the devices and subsystems of the exemplary embodiments, for driving the devices and subsystems of the exemplary embodiments, for processing data and signals, for enabling the devices and subsystems of the exemplary embodiments to interact with a human user or the like. Such software can include, but is not limited to, device drivers, firmware, operating systems, development tools, applications software, and the like. Common forms of computer-readable media may include, for example, magnetic disks, flash memory, RAM, a PROM, an EPROM, a FLASH-EPROM, or any other suitable memory chip or medium from which a computer or processor can read.

While the present disclosure describes various embodiments for illustrative purposes, such description is not intended to be limited to such embodiments. On the contrary, the applicant's teachings described and illustrated herein encompass various alternatives, modifications, and equivalents, without departing from the embodiments, the general scope of which is defined in the appended claims. Information as herein shown and described in detail is fully capable of attaining the above-described object of the present disclosure, the presently preferred embodiment of the present disclosure, and is, thus, representative of the subject matter which is broadly contemplated by the present disclosure.

What is claimed is:

1. A fitness system, comprising:

two adjustable webbing attachment loops; and a load cell device comprising:

a casing;

a load cell fittingly housed within said casing;

one or more attachment means for removably attaching said two adjustable webbing attachment loops to the load cell oriented perpendicular to each other, each loop extending, when installed, outward from the device in the direction of force measurement;

a processor coupled to a non-transitory computer-readable medium and the load cell and configured to measure a force applied on the load cell by the two adjustable webbing attachment loops;

a load cell sensor portion coupled to the processor;

a first anchoring block affixed at a first end of the load cell sensor portion, the first anchoring block comprising at two opposite ends thereof a protrusion extending outwardly laterally from a corresponding lateral aperture in the casing to serve as an attachment point for each of two adjustable webbing clasps, a first attachment loop of said two adjustable webbing attachment loops attached via said two adjustable webbing clasps; and a second anchoring block affixed at a second end of the load cell sensor portion, opposite the first anchoring block, the second anchoring block and the load cell sensor portion defining a space therebetween for receiving a second attachment loop of said two adjustable webbing attachment loops.

2. The fitness system of claim 1, wherein the second anchoring block has a substantially rounded surface opposite the load cell sensor portion for engaging the second loop thereon when force is applied.

3. The fitness system of claim 1, further comprising a wireless networking module communicatively coupled to the processor, and configured to communicate force-related data to a user device.

4. The fitness system of claim 1, further comprising:

an exercise bar comprising:

an elongated body comprising along a length thereof one or more markings for hand placement; and a coupling means at one end of said body to removably couple the exercise bar to one of the attachment loops so as to provide targeted torque resistance.

5. The fitness system of claim 4, wherein the one or more markings comprise:

a center marking; and one or more pairs of secondary markings, each pair of secondary markings being located on opposite sides of the center marking and equidistantly spaced from the center marking.

6. The fitness system of claim 4, wherein the coupling means is an eyelet extending outwardly from said end parallel to said length.

7. The fitness system of claim 1, wherein the non-transitory computer-readable medium comprises instructions that, when executed, cause the processor to at least:

receive force-related data from the load cell;

identify one or more peak in the force-related data; and evaluate the one or more peak against one or more predefined criteria by:

identifying one or more peak value exceeding a threshold or being smaller than a designated ratio of a total peak weight.

8. The fitness system of claim 7, wherein the load cell device further comprises a digital display communicatively coupled to the processor, and wherein the instructions further causing the processor to at least display at least the peak value on the digital display.

9. The fitness system of claim 7, further comprising:

a user device communicatively coupled to the load cell device via one or more networks, the user device comprising a user interface, the user device receiving said identified peak value from said load cell device for tracking performance.

10. The fitness system of claim 9, the user device comprising a second processor coupled to a second non-transitory computer-readable medium comprising instructions that, when executed by the second processor, cause the second processor to at least:

display a list of exercises to be performed by the load cell device by a user;

receive, by the user via the user interface, a selection of one or more exercises from the list;

prescribe, based on the selection, an effort per repetition and an accumulated force generation goal; and track a realization of said effort per repetition or accumulated force generation goal based on said identified peak values.

11. The fitness system of claim 10, wherein the accumulated force generation goal is calculated per exercise set, per workout, within a set number of workouts or within a fixed timeline.

12. The fitness system of claim 10, wherein the effort per repetitions comprises at least one of: a minimum effort per repetition or a maximum effort per repetition.

* * * * *